US005866967A

United States Patent [19]

Sasaki

[11] Patent Number: 5,866,967

[45] Date of Patent: Feb. 2, 1999

[54] SLIP RING MECHANISM OF NON-SLIDING TYPE

[75] Inventor: Akira Sasaki, Tokyo, Japan

[73] Assignee: Kabushiki Kaisha Toshiba, Kawasaki, Japan

[21] Appl. No.: 962,661

[22] Filed: Nov. 3, 1997

[30] Foreign Application Priority Data

Nov. 12, 1996 [JP] Japan ..... 8-300498

[51] Int. Cl.[6] ..... H01R 39/08

[52] U.S. Cl. ..... 310/232; 310/11; 310/89; 439/5

[58] Field of Search ..... 310/232, 11, 156, 310/89

[56] References Cited

U.S. PATENT DOCUMENTS 3,972,577 8/1976 Charles et al. ..... 339/5

4,063,792 12/1977 Lodge ..... 339/5

4,566,744 1/1986 Engelenburg et al. ..... 339/8

*Primary Examiner*—Nestor Ramirez

*Assistant Examiner*—Thanh Lam

*Attorney, Agent, or Firm*—Oblon, Spivak, McClelland, Maier & Neustadt, P.C.

[57] ABSTRACT

Magnetic fluid is inserted between slip rings of a rotor and brushes of a stator. The magnetic fluid is held by magnetic force generated by permanent magnets and yokes mounted on the stator, so as to be sidable relative to the slip rings. In this state, in accordance with rotation of the rotor, the brushes and the slip rings are rotated without direct contact with each other via the magnetic fluid. Thus, the brushes and the slip rings are electrically connected to each other.

48 Claims, 2 Drawing Sheets

SLIP RING MECHANISM OF NON-SLIDING TYPE

BACKGROUND OF THE INVENTION

The present invention relates to a slip ring mechanism adapted for use in extreme conditions, for example, space and a vacuum.

Generally, spacecraft, such as an artificial satellite, is equipped with various space apparatuses, for example, an antenna apparatus including a rotary driving portion. Such an apparatus on spacecraft includes a well-known slip ring mechanism as means for transmitting or receiving a signal including power to or from the rotary portion. In the slip ring mechanism, a rotor having slip rings is coaxially attached to the rotation axis of a rotary portion. A stator having brushes is attached to a fixture support. When the rotor is rotated in accordance with the rotation of the rotary portion, the brushes of the stator are slid on the slip rings of the rotor. As a result, a signal is transmitted between the rotor and the stator.

When the aforementioned slip ring mechanism is used in space of a very high temperature and vacuum, it is difficult to use oil or grease as a lubricant as is used on the ground.

There are two types in slip ring mechanisms for use in space: one is sliding type, and the other non-sliding type. In the case of a slip ring mechanism of sliding type, the slip rings and brushes are made of self-lubricant material, such as gold or silver, to transmit signals between the rotor and the stator. In the case of a slip ring mechanism of non-sliding type, conductive fluid, e.g., mercury, is interposed between the slip rings and the brushes, so that the slip rings may not directly slide on the brushes. In this state, signals are transmitted between the rotor and the stator.

However, the slip ring mechanism of sliding type has the following drawbacks. The lifetime of this type is short, because the rings or brushes are liable to wear and the electric performance is easily lowered due to its structure.

In the slip ring mechanism of non-sliding type, the structure of arrangement of the conductive fluid is very complicated. Moreover, since it is difficult to completely prevent the fluid from leakage, the mechanism has only low reliability.

These problems occur also in extreme conditions on the ground, for example, in a vacuum, where it is difficult to use oil or grease as a lubricant.

BRIEF SUMMARY OF THE INVENTION

An object of the present invention is to provide a slip ring mechanism which has a simple structure and high performance, and by which signal transmission with a high reliability can be achieved.

The above object is achieved by a slip ring mechanism comprising: a stator having brushes; a rotor having slip rings opposed to the brushes of the stator with a gap; magnetic fluid, inserted between the brushes of the stator and the slip rings of the rotor, for electrically connecting the brushes and the slip rings; and fluid holding means for slidably holding and positioning the magnetic fluid between the brushes of the stator and the slip rings of the rotor by means of magnetic force.

Additional objects and advantages of the invention will be set forth in the description which follows, and in part will be obvious from the description, or may be learned by practice of the invention. The objects and advantages of the invention may be realized and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiments of the present invention will be described in detail with reference to the accompanying drawings.

Figure 1:
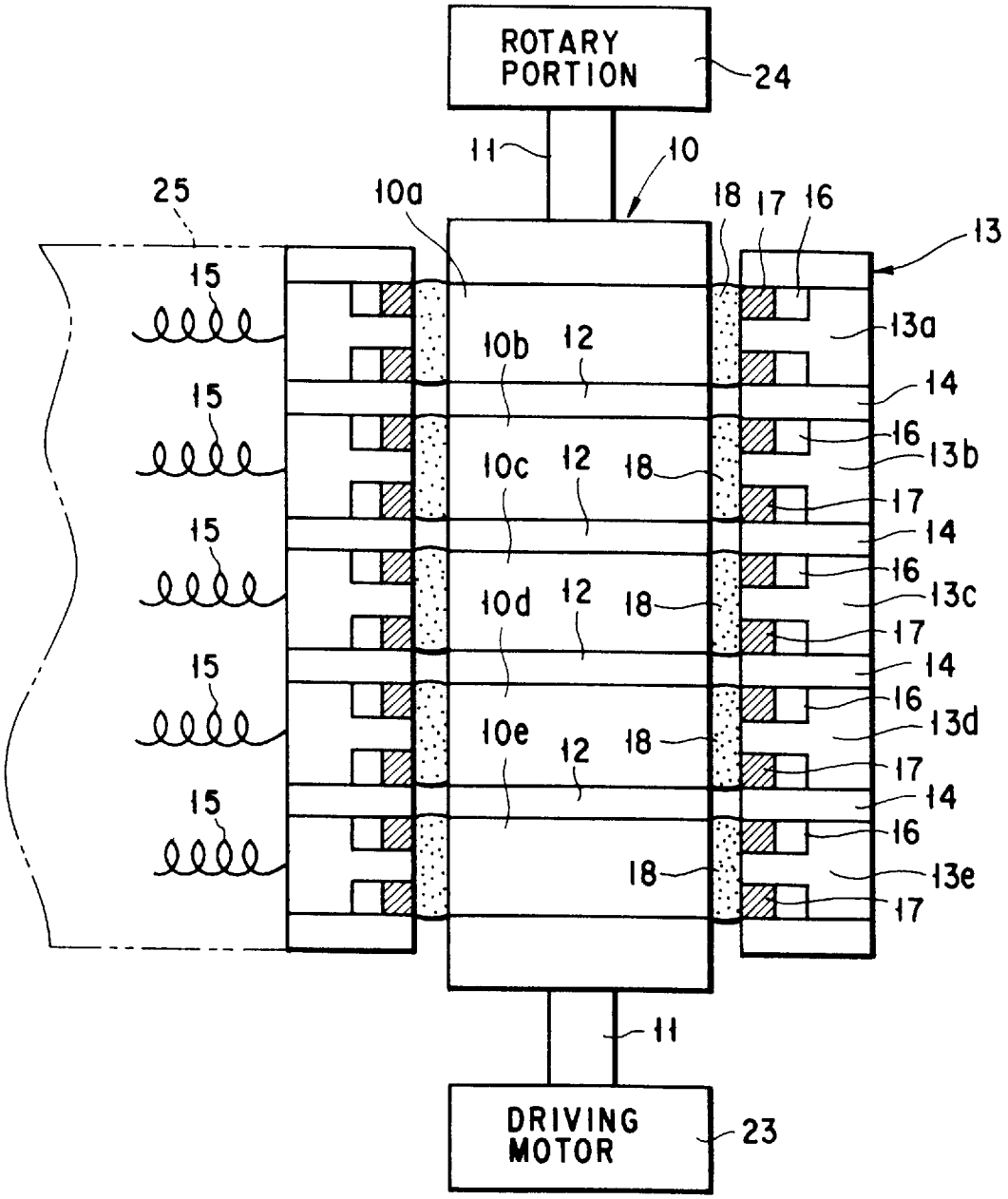
FIG. 1 is a cross-sectional view of a slip ring mechanism according to an embodiment of the present invention.

FIG. 1 shows a slip ring mechanism according to an embodiment of the present invention. A rotor 10 has a rotation axis 11 projected from both ends thereof. One of the ends of the rotation axis 11 is coaxially fixed to a rotation axis of a driving motor 23.

The other end of the rotation axis 11 is coaxially fixed to a rotation axis of a rotary portion 24 of, for example, equipment on spacecraft. A plurality of ring-shaped slip rings 10*a* to 10*e*, coaxially placed one on another, are provided around the rotor 10. The slip rings 10*a* to 10*e* are separated from one another with a gap therebetween. An insulator 12 is inserted in each gap. The slip rings 10*a* to 10*e* are electrically connected to electronic parts in the rotary portion 24.

A stator 13 of, for example, a cylindrical shape, is mounted around the rotor 10. The stator 13 is fixed to a fixture support 25 of the equipment on the spacecraft. On the inner wall of the stator 13, a plurality of brushes 13*a* to 13*e* of, for example, a cylindrical shape, are coaxially placed one on another so as to be opposed to the slip rings 10*a* to 10*e* of the rotor 10. The brushes are separated from one another with a gap therebetween. An insulator 14 is inserted in each gap.

The slip rings 10*a* to 10*e* of the rotor 10 are respectively opposed to and paired with the brushes 13*a* to 13*e* of the stator 13. The brushes 13*a* to 13*e* of the stator 13 are electrically connected to electronic parts in the fixture support 25 through cables 15.

Fluid holding means, comprising, for example, a permanent magnet 16 and a yoke 17 called a pole piece, is mounted on the base portion of each of the brushes 13*a* to 13*e*. Magnetic fluid 18 having a high conductivity is provided on the top end portions of the yokes 17.

The magnetic fluid 18 is a colloidal material in which iron powder is dispersed in perfurolopolyether (PEPE). It has a volume resistivity of about 0.01 Ω·m. Magnetic force of the permanent magnets 16 is applied to the magnetic fluid 18 via the yokes 17, so that the magnetic fluid 18 can be positioned so as to be slidable relative to the slip rings 10*a* to 10*e*.

In the above structure, the slip rings 10*a* to 10*e* of the rotor 10 are opposed to the brushes 13*a* to 13*e* of the stator 13, via the magnetic fluid 18 positioned and held by the permanent magnets 16 and the yokes 17. When the driving motor 23 is driven, the driving force is transmitted to the rotor 10 and the rotary portion 24 via the driving axis 11. As a result, the rotor 10 and the rotary portion 24 are rotated in synchronism with each other.

Accordingly, the brushes 13*a* to 13*e* of the stator 13 are slid on the slip rings 10*a* to 10*e* of the rotor 10 via the magnetic fluid 18. Thus, the brushes 13*a* to 13*e* and the slip rings 10*a* to 10*e* are electrically connected to each other via the magnetic fluid 18, without direct contact (non-sliding state). In this state, the magnetic fluid 18 is positioned and held between the slip rings 10*a* to 10*e* and the brushes 13*a* to 13*e* by means of magnetic force generated by the permanent magnets 16 and the yokes 17.

As the rotor 10 is rotated, a signal, including power, is transmitted between the slip rings 10*a* to 10*e* and the brushes 13*a* to 13*e* of the stator 13. Thus, when the rotary portion 24 is rotating, the rotary portion 24 is electrically connected to an electronic element of the fixture support 25 via the slip rings 10*a* to 10*e* of the rotor 10 and the brushes 13*a* to 13*e* of the stator 13.

As described above, in the above slip ring mechanism, the magnetic fluid 18 is inserted between the slip rings 10*a* to 10*e* of the rotor 10 and the brushes 13*a* to 13*e* of the stator 13, and slidably positioned and held between the slip rings 10*a* to 10*e* and the brushes 13*a* to 13*e* by means of magnetic force generated by the permanent magnets 16 and the yokes 17. Thus, the brushes 13*a* to 13*e* and the slip rings 10*a* and 10*e* are rotated without direct contact with each other (non-sliding state), resulting in electrical contact with each other via the magnetic fluid 18.

With the above structure, since the magnetic fluid 18 can be positioned and held easily and accurately, substantially constant static resistance and dynamic resistance can be secured. Therefore, stable starting torque is maintained, thereby realizing operation control of high reliability. In addition, since the brushes 13*a* to 13*e* and the slip rings 10*a* to 10*e* wear very little, the lifetime of the mechanism is lengthened.

Figure 2:
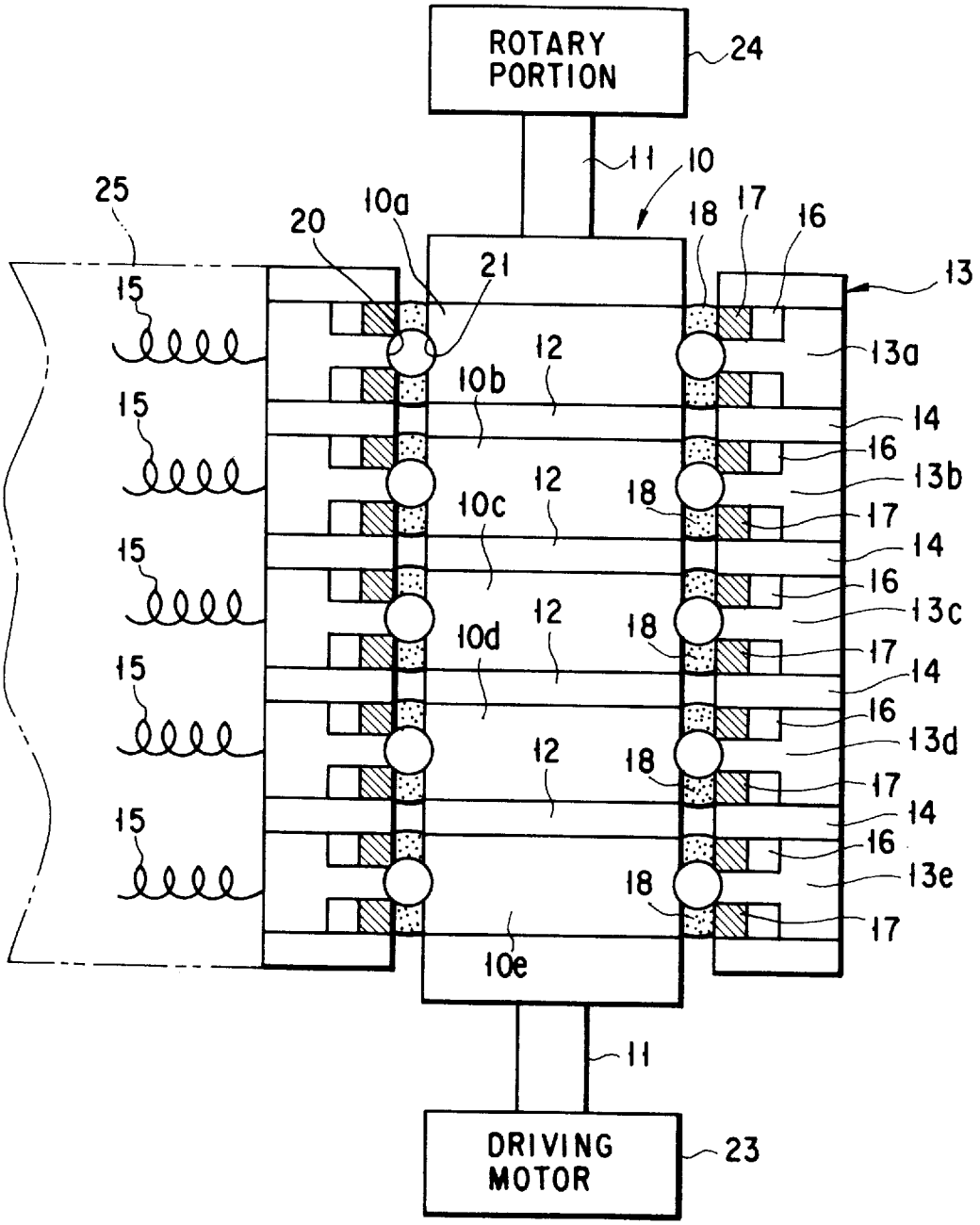
FIG. 2 is a cross-sectional view of a slip ring mechanism according to another embodiment of the present invention.

The present invention is not limited to the above embodiment, but can be embodied as shown in FIG. 2. In FIG. 2, the portion corresponding to that shown in FIG. 1 is identified with the same reference numeral as used in FIG. 1, and a description thereof will be omitted.

As shown in FIG. 2, ball guide grooves 20 and 21 are formed in brushes 13*a* to 13*e* and slip rings 10*a* to 10*e*. A plurality of balls 22 are rotatably and movably inserted between the ball grooves 20 and 21, thus forming a bearing coupling mechanism, a so-called ball bearing mechanism. In the same manner as in the aforementioned embodiment, magnetic fluid 18 is inserted between the slip rings 10*a* to 10*e* of the rotor 10 and the brushes 13*a* to 13*e* of the stator 13, so as to entirely cover the balls 22. The magnetic fluid 18 is slidably positioned and held between the slip rings 10*a* to 10*e* and the brushes 13*a* to 13*e* by means of fluid holding means comprising, for example, permanent magnets 16 and yokes 17.

In the above structure, as the driving motor 23 is driven, the rotor 10 and the rotary portion 24 are rotated. Accordingly, the balls 22 are rotated and slid between the slip rings 10*a* to 10*e* of the rotor 10 and the brushes 13*a* and 13*e* of the stator 13. As a result, the slip rings 10*a* to 10*e* of the rotor 10 and the brushes 13*a* and 13*e* of the stator 13 are electrically connected to each other via both the balls 22 and the magnetic fluid 18 rotating and slid between the slip rings 10*a* to 10*e* and the brushes 13*a* to 13*e*.

With the above structure, since the slip rings 10*a* to 10*e* and the brushes 13*a* to 13*e* slide on the balls 22, the friction therebetween and the wear of these elements are reduced. In addition, since substantially constant low static resistance and dynamic resistance can be secured, electric performance with high reliability and accuracy can be maintained for a long period of time.

The balls 22 may be coated with solid lubricant film, such as $MOS_2$ film. With this structure, the rolling characteristic of the balls 22, rotating and sliding between the slip rings 10*a* to 10*e* and the brushes 13*a* to 13*e*, is further improved, and the static resistance and dynamic resistance are further reduced. Consequently, higher electric performance can be obtained.

In the above embodiments, a plurality of pairs of the slip rings 10*a* to 10*e* and brushes 13*a* to 13*e* are coaxially placed one on another. However, the present invention is applicable to a mechanism in which a single pair of a slip ring and a brush is used.

In the above embodiments, the permanent magnets 16 and the yokes 17 constituting the fluid holding means are mounted on the stator 13. However, the fluid holding means can be mounted on the rotor 10. Alternatively, the permanent magnets and the yokes 17 can be separately mounted on the stator 13 and the rotor 10.

Further, although the ring-shaped brushes 13*a* to 13*e* are used in the above embodiments, another shape of brushes, as well as the ring-shaped brushes, can be applied to the embodiment shown in FIG. 1.

Although the fluid holding means of the above embodiments is constituted by the permanent magnets 16 and the yokes 17, it can be formed of another structure.

As described above, the present invention is not limited to the above embodiments, but can be variously modified within the scope of the gist of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit of scope of the general inventive concept as defined by the appended claims and their equivalents.

I claim:

1. A slip ring mechanism comprising:

a stator having brushes;

a rotor having slip rings opposed to the brushes of the stator with a gap;

magnetic fluid, inserted between the brushes of the stator and the slip rings of the rotor, for electrically connecting the brushes and the slip rings; and fluid holding means for slidably holding and positioning the magnetic fluid between the brushes of the stator and the slip rings of the rotor by means of magnetic force.

2. A slip ring mechanism comprising:

a stator having brushes;

a rotor having slip rings opposed to the brushes of the stator with a gap;

bearing coupling means having a plurality of balls rotatable between the brushes of the stator and the slip rings of the rotor, the plurality of balls being rotated and slid between the brushes and the slip rings in accordance with rotation of the rotor;

magnetic fluid, inserted between the brushes of the stator and the slip rings of the rotor to cover the bearing coupling means, for electrically connecting the brushes and the slip rings; and fluid holding means for slidably holding and positioning the magnetic fluid between the brushes of the stator and the slip rings of the rotor by means of magnetic force.

3. The slip ring mechanism according to claim 1, wherein the fluid holding means are mounted on the rotor and slidably hold and position the magnetic fluid to the brushes of the stator by means of magnetic force.

4. The slip ring mechanism according to claim 2, wherein the fluid holding means are mounted on the rotor and slidably hold and position the magnetic fluid to the brushes of the stator by means of magnetic force.

5. The slip ring mechanism according to claim 1, wherein the fluid holding means are mounted on the stator and slidably hold and position the magnetic fluid to the slip rings of the rotor by means of magnetic force.

6. The slip ring mechanism according to claim 2, wherein the fluid holding means are mounted on the stator and slidably hold and position the magnetic fluid to the slip rings of the rotor by means of magnetic force.

7. The slip ring mechanism according to claim 1, wherein the fluid holding means are mounted on the rotor and the stator and slidably hold and position the magnetic fluid between the slip rings of the rotor and the brushes of the stator by means of magnetic force.

8. The slip ring mechanism according to claim 2, wherein the fluid holding means are mounted on the rotor and the stator and slicably hold and position the magnetic fluid between the slip rings of the rotor and the brushes of the stator by means of magnetic force.

9. The slip ring mechanism according to claim 2, wherein the plurality of balls are coated with solid lubricant film.

10. The slip ring mechanism according to claim 4, wherein the plurality of balls are coated with solid lubricant film.

11. The slip ring mechanism according to claim 6, wherein the plurality of balls are coated with solid lubricant film.

12. The slip ring mechanism according to claim 8, wherein the plurality of balls are coated with solid lubricant film.

13. The slip ring mechanism according to claim 1, wherein the brushes are coaxially arranged one on another via insulators and mounted on the stator and the slip rings are coaxially arranged one on another via insulators and mounted on the rotor, the slip rings being opposed to the brushes.

14. The slip ring mechanism according to claim 2, wherein the brushes are coaxially arranged one on another via insulators and mounted on the stator and the slip rings are coaxially arranged one on another via insulators and mounted on the rotor, the slip rings being opposed to the brushes.

15. The slip ring mechanism according to claim 3, wherein the brushes are coaxially arranged one on another via insulators and mounted on the stator and the slip rings are coaxially arranged one on another via insulators and mounted on the rotor, the slip rings being opposed to the brushes.

16. The slip ring mechanism according to claim 4, wherein the brushes are coaxially arranged one on another via insulators and mounted on the stator and the slip rings are coaxially arranged one on another via insulators and mounted on the rotor, the slip rings being opposed to the brushes.

17. The slip ring mechanism according to claim 5, wherein the brushes are coaxially arranged one on another via insulators and mounted on the stator and the slip rings are coaxially arranged one on another via insulators and mounted on the rotor, the slip rings being opposed to the brushes.

18. The slip ring mechanism according to claim 6, wherein the brushes are coaxially arranged one on another via insulators and mounted on the stator and the slip rings are coaxially arranged one on another via insulators and mounted on the rotor, the slip rings being opposed to the brushes.

19. The slip ring mechanism according to claim 7, wherein the brushes are coaxially arranged one on another via insulators and mounted on the stator and the slip rings are coaxially arranged one on another via insulators and mounted on the rotor, the slip rings being opposed to the brushes.

20. The slip ring mechanism according to claim 8, wherein the brushes are coaxially arranged one on another via insulators and mounted on the stator and the slip rings are coaxially arranged one on another via insulators and mounted on the rotor, the slip rings being opposed to the brushes.

21. The slip ring mechanism according to claim 9, wherein the brushes are coaxially arranged one on another via insulators and mounted on the stator and the slip rings are coaxially arranged one on another via insulators and mounted on the rotor, the slip rings being opposed to the brushes.

22. The slip ring mechanism according to claim 10, wherein the brushes are coaxially arranged one on another via insulators and mounted on the stator and the slip rings are coaxially arranged one on another via insulators and mounted on the rotor, the slip rings being opposed to the brushes.

23. The slip ring mechanism according to claim 11, wherein the brushes are coaxially arranged one on another via insulators and mounted on the stator and the slip rings are coaxially arranged one on another via insulators and mounted on the rotor, the slip rings being opposed to the brushes.

24. The slip ring mechanism according to claim 12, wherein the brushes are coaxially arranged one on another via insulators and mounted on the stator and the slip rings are coaxially arranged one on another via insulators and mounted on the rotor, the slip rings being opposed to the brushes.

25. The slip ring mechanism according to claim 1, wherein the fluid holding means comprise permanent magnets and yokes.

26. The slip ring mechanism according to claim 2, wherein the fluid holding means comprise permanent magnets and yokes.

27. The slip ring mechanism according to claim 3, wherein the fluid holding means comprise permanent magnets and yokes.

28. The slip ring mechanism according to claim 4, wherein the fluid holding means comprise permanent magnets and yokes.

29. The slip ring mechanism according to claim 5, wherein the fluid holding means comprise permanent magnets and yokes.

30. The slip ring mechanism according to claim 6, wherein the fluid holding means comprise permanent magnets and yokes.

31. The slip ring mechanism according to claim 7, wherein the fluid holding means comprise permanent magnets and yokes.

32. The slip ring mechanism according to claim 8, wherein the fluid holding means comprise permanent magnets and yokes.

33. The slip ring mechanism according to claim 9, wherein the fluid holding means comprise permanent magnets and yokes.

34. The slip ring mechanism according to claim 10, wherein the fluid holding means comprise permanent magnets and yokes.

35. The slip ring mechanism according to claim 11, wherein the fluid holding means comprise permanent magnets and yokes.

36. The slip ring mechanism according to claim 12, wherein the fluid holding means comprise permanent magnets and yokes.

37. The slip ring mechanism according to claim 13, wherein the fluid holding means comprise permanent magnets and yokes.

38. The slip ring mechanism according to claim 14, wherein the fluid holding means comprise permanent magnets and yokes.

39. The slip ring mechanism according to claim 15, wherein the fluid holding means comprise permanent magnets and yokes.

40. The slip ring mechanism according to claim 16, wherein the fluid holding means comprise permanent magnets and yokes.

41. The slip ring mechanism according to claim 17, wherein the fluid holding means comprise permanent magnets and yokes.

42. The slip ring mechanism according to claim 18, wherein the fluid holding means comprise permanent magnets and yokes.

43. The slip ring mechanism according to claim 19, wherein the fluid holding means comprise permanent magnets and yokes.

44. The slip ring mechanism according to claim 20, wherein the fluid holding means comprise permanent magnets and yokes.

45. The slip ring mechanism according to claim 21, wherein the fluid holding means comprise permanent magnets and yokes.

46. The slip ring mechanism according to claim 22, wherein the fluid holding means comprise permanent magnets and yokes.

47. The slip ring mechanism according to claim 23, wherein the fluid holding means comprise permanent magnets and yokes.

48. The slip ring mechanism according to claim 24, wherein the fluid holding means comprise permanent magnets and yokes.

* * * * *